United States Patent [19]

Conneally

[11] Patent Number: 4,860,455

[45] Date of Patent: Aug. 29, 1989

[54] SINGLE HAND OPERATION CAN OPENER

[75] Inventor: Martin L. Conneally, Lombard, Ill.

[73] Assignee: Sears, Roebuck & Co., Chicago, Ill.

[21] Appl. No.: 149,392

[22] Filed: Jan. 28, 1988

[51] Int. Cl.[4] ..... B67B 7/38

[52] U.S. Cl. ..... 30/404; 30/405; 30/424

[58] Field of Search ..... 30/401, 403, 404, 405, 30/423, 424, 425

[56] References Cited

U.S. PATENT DOCUMENTS

| | | |
|---|---|---|
| Re. 24,994 | 5/1961 | Congdon . |
| 2,441,322 | 5/1948 | Jager . |
| 2,484,504 | 10/1949 | Hanby . |
| 2,603,857 | 7/1952 | Hanby . |
| 2,755,547 | 7/1956 | Hanby . |
| 3,000,095 | 9/1961 | Moran . |
| 3,060,568 | 10/1962 | Nisenson . |
| 3,069,771 | 12/1962 | Moran . |
| 3,550,271 | 12/1970 | Meyer et al. . |
| 4,028,805 | 6/1977 | Figlia . |

*Primary Examiner*—Frank T. Yost
*Assistant Examiner*—Michael D. Folkerts
*Attorney, Agent, or Firm*—Wood, Dalton, Phillips, Mason & Rowe

[57] ABSTRACT

An automatic can opener is described which is operable using a single hand to complete the opening of a can merely by positioning the can in an opening position. Particularly, the can opener senses when a can has been placed in a position to be opened, and automatically retains the can in this position and begins cutting the top thereof. Subsequently, when the cutting is completed, the can opener automatically terminates the cutting operation while retaining the can in position. Thereafter, when a user begins to remove the can, such action is automatically sensed, and the can is automatically released for removal.

26 Claims, 3 Drawing Sheets

SINGLE HAND OPERATION CAN OPENER

DESCRIPTION

1. Field of the Invention

This invention relates generally to can openers, and more particularly, to a can opener which requires use of a single hand for operation thereof 2. Background of the Invention Many known can openers utilize a mechanical lever for positioning a cutting blade proximate to a turning wheel for retaining the upper lip of a can therebetween. The lever also actuates a switch to start a motor which rotates the turning wheel thereby causing the can to rotate with the cutting blade cutting through the top around the periphery thereof. Once the cutting operation is completed, the lever is released to stop the motor and move the cutting blade away from the can to release same. Such a can opener requires the use of two hands—one to support the can, and one to operate the lever.

An automated form of such a can opener is described in Congdon U.S. Pat. Reissue No. RE 24,994. The can opener described therein starts automatically when the underside of the lip of a can is placed against the turning wheel and the can is tilted sufficiently to apply pressure to the blade to thereby operate a switch. The switch starts a motor which automatically causes the blade to move downwardly to pierce the can and retain the lip of the can between the blade and the turning wheel. Simultaneously, the turning wheel begins turning to rotate the can for removing the top, as above. Once the can has completed its rotation, back pressure against the blade is released causing the switch to shut-off and stop the motor. When the can is subsequently grasped and tilted sufficiently, the blade is pushed away from the can and locked into a remote position to allow for removal of the can.

The automatic can opener described in the Congdon Patent is believed undesirable in that it requires an otherwise unnatural manual manipulation of the can in order to start the operation of the can opener, and also to subsequently remove the can therefrom. It is believed that such manipulation might be difficult for certain handicapped or arthritic individuals.

The present invention is intended to overcome these and other problems associated with prior can openers.

SUMMARY OF THE INVENTION

In accordance with the present invention, a can opener is operable to complete a entire cutting operation with minimal manual operation.

Broadly, there is disclosed herein an automatic can opener which is operable to retain and begin cutting the top of a can responsive only to the can being positioned proximate the can opener, and thereafter to automatically stop the cutting operation and release the can responsive to the can being drawn away from the can opener.

Specifically, the automatic can opener according to the invention includes a housing having an outer wall which defines an inner chamber. A rotary turning wheel is positioned outwardly of the wall and has a shaft which extends through an opening in the wall into the chamber. An electrical motor is mounted in the chamber and has an output shaft which is coupled through a suitable gear arrangement to the turning wheel shaft to rotate same. A cutting blade is mounted to a plate which is pivotally mounted to the wall with the blade in spaced relation to the turning wheel. Particularly, the plate is pivotally moveable over a limited range with the plate biased so that the blade is normally remote from the turning wheel. An actuator is coupled between the gear arrangement and the plate for converting rotary movement of the gears to pivotal movement of the plate. A latch is responsive to movement of the actuator for latching the actuator in position so that the blade is spaced from the turning wheel a relatively short distance sufficient to retain the upper lip of the can therebetween. An electrical solenoid is mounted in the chamber and is operable when energized to engage the latch causing it to unlatch the actuator to return the plate to its normal biased position, so that the blade is remote from the turning wheel to allow for removal of the can.

A turning wheel switch is positioned adjacent the turning wheel and is actuable responsive to a can being positioned with its sidewall against the face of the turning wheel. A stand-off switch is mounted below the turning wheel outwardly of the outer wall and is actuable responsive to a can being positioned with sidewall thereof proximate the wall. Accordingly, when a can is placed in the conventional manner adjacent the can opener, with its upper lip resting on the turning wheel, both switches are actuated. An end-of-cut switch is actuated when the blade in its downward position has completely cut around the periphery of the top of the can. A control circuit is coupled to the switches, the motor and the solenoid. Specifically, the circuit is wired so that if the can opener is in a neutral state and a can to be opened is subsequently positioned proximate the can opener, the turning wheel and stand-off switches are actuated to start the motor. Operation of the motor causes the turning wheel to begin rotating, and moves the actuator to pivot the plate and blade downwardly to the latched position. Accordingly, the blade and turning wheel are closely spaced to support the upper lip of the can therebetween, with the blade piercing the top of the can. The turning of the wheel causes the can to rotate so that the blade cuts around the entire periphery of the can top until a complete cut has been made. When the cut has been completed, back pressure on the actuator blade is released so that the blade drops further, actuating the end-of-cut switch shifting one side of the power from the motor to the solenoid, causing the motor to stop and the can to stop rotating. Nevertheless, the upper lip of the can is still retained between the blade and the turning wheel. Subsequently, when a user grasps the can and begins to pull the can away, such that the sidewall of the can is moved slightly away from the wall, the stand-off switch returns to its rest position and shifts the other side of the power from the motor to the solenoid, thereby energizing the solenoid to automatically release the actuator so that the plate is biased to its upward position. Accordingly, the blade is remotely spaced from the turning wheel so that the upper lip of the can is no longer retained therebetween and the can may be simply removed.

By utilizing the stand-off switch and turning wheel switch described above, the can opener is operable to automatically retain the can and start its cutting operation responsive only to the can being positioned forwardly of the can opener such that both switches are actuated. At the completion of the cutting operation, while the can is still being retained, grasping the can moves the lower end thereof slightly so that the stand-off switch is no longer actuated. Responsively, the blade automatically moves away from the turning wheel to release the can for removal.

Further features and advantages of the invention will readily be apparent from the specification and from the drawings.

DESCRIPTION OF THE PREFERRED EMBODIMENT

Figure 1:
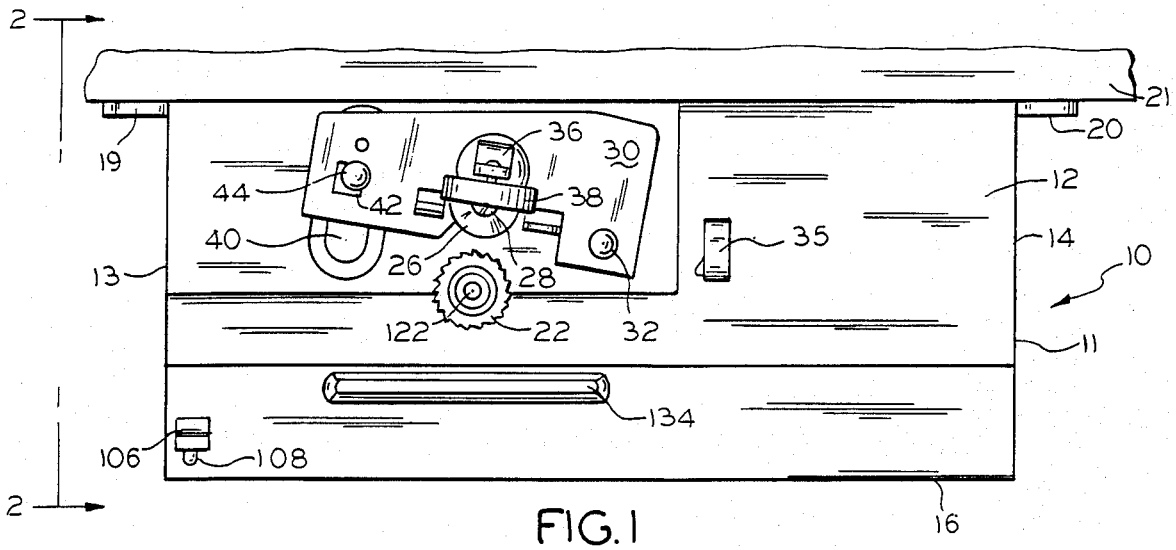
FIG. 1 is a front elevational view of a single hand operation can opener according to the present invention.

In one embodiment of the invention as disclosed in FIGS. 1–9 a can opener 10 includes a housing 11 having a front wall 12, side walls 13 and 14, a rear wall 15, a bottom wall 16 and a top wall 17 defining a inner chamber 18. Coupled to the side walls 13 and 14, along the top wall 17, are respective flanges 19 and 20 for fastening the housing to the underside of a cabinet 21 using suitable fasteners (not shown).

Although the illustrated can opener 10 comprises an under cabinet mounted unit, a can opener according to the present invention could be provided as a counter top style unit, a wall mounted unit or a flush mounted unit as is obvious to those skilled in the art.

Figure 2:
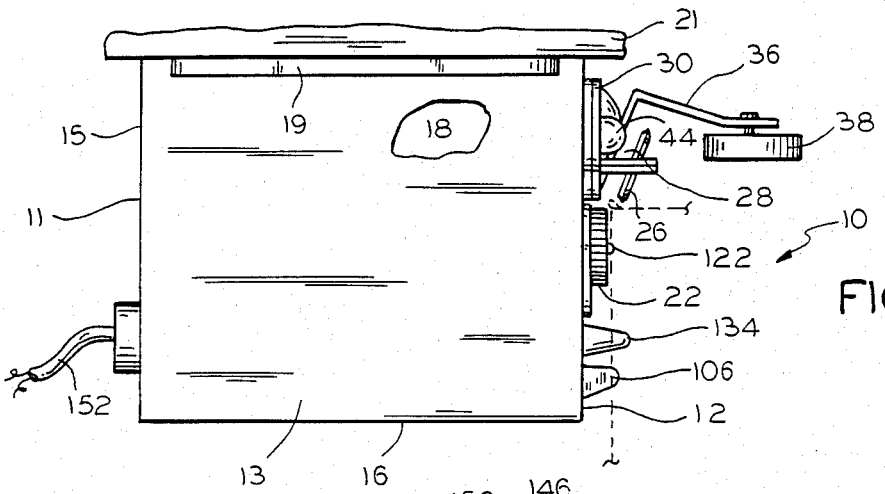
FIG. 2 is a side elevational view taken along the lines 2—2 of FIG. 1.
Figure 8:
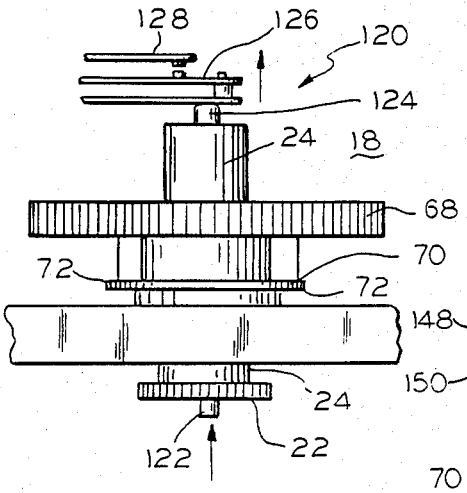
FIG. 8 is a detailed view illustrating a turning wheel switch for the can opener of FIG. 1.

With particular reference to FIGS. 1 and 2, a can turning wheel 22 having suitable teeth on the periphery thereof for gripping the lower edge of the lip at the top of a can is affixed at the outer end of a drive shaft 24, See FIG. 8, for rotation therewith. The drive shaft 24 extends through a suitable opening in the front wall 12 into the chamber 18. A can cutting blade wheel 26 having a relatively sharp edge about its periphery is loosely mounted in a conventional manner to a diagonally downwardly extending shaft 28 affixed to a plate 30. Alternatively, a cutting plow (not shown) could be provided rigidly mounted to the plate 30. The plate 30 is pivotally mounted to the front wall 12 with a pin 32 extending through suitable openings in the plate 30 and the front wall 12. The pin 32 is held in place internally by a latching mechanism 34 connected to a handle 35. Accordingly, the plate 30 is pivotal about the pin 32. Moreover, by depressing the handle 35, the pin 32 is released so that the plate 30 may be removed for cleaning or replacement of the blade 26 as necessary. Also coupled to the plate 30 is an elongated arm 36 having a magnet 38 coupled to a distal end thereof for retaining the top of a can which has been removed by the cutting blade 26.

An elongated oval shaped opening 40 is provided through the front wall 12 to the left and above the position of the turning wheel 22. A smaller opening 42 is provided through the plate 30 in alignment with the opening 40. A rod 44 extends through each of the openings 40 and 42 to control pivotal movement of the plate 30 about the pin 32, as defined by the longitudinal extent of the elongated opening 40. The rod 44 is attached to a plate 46 forming part of an actuator 45, See FIG. 7, mounted in the chamber 18. A suitable spring 4 is connected under tension to the actuator 45 and the inner side of the front wall 12 to bias the plate 46 upwardly, thus causing the pivotal plate 30 to assume a normal upward biased position s that the blade 26 is spaced somewhat remotely from the turning wheel 22, as illustrated in FIG. 1.

Figure 5:
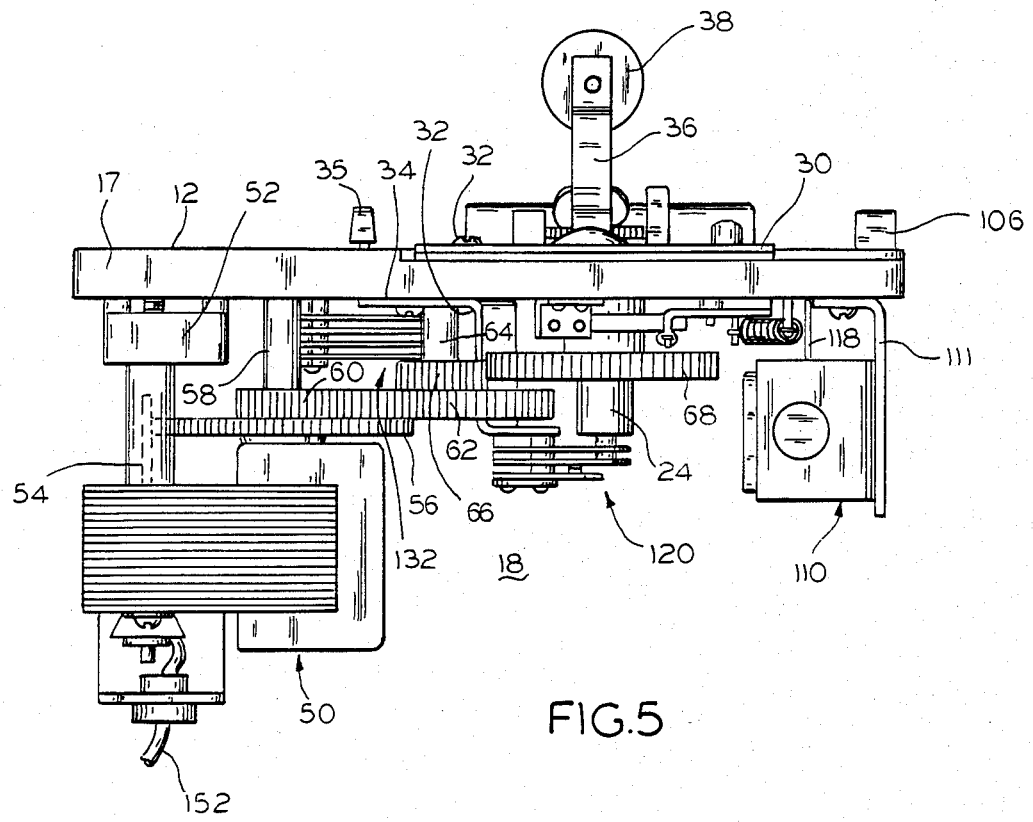
FIG. 5 is an upper plan view taken along the lines 5—5 of FIG. 4.
Figure 4:
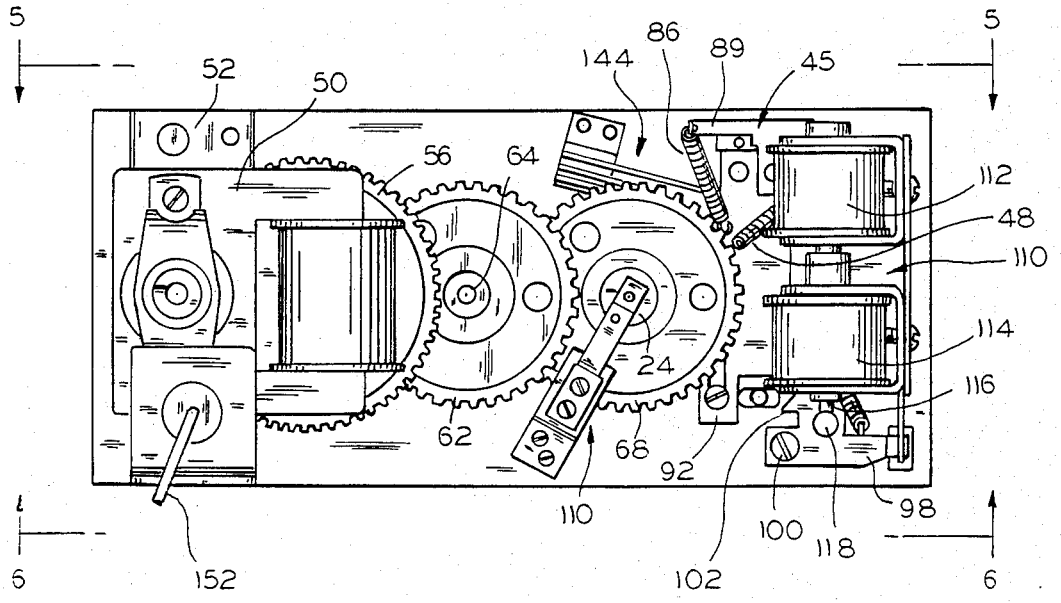
FIG. 4 is a rear elevational view of the can opener of FIG. 1 with a portion of the housing removed.
Figure 6:
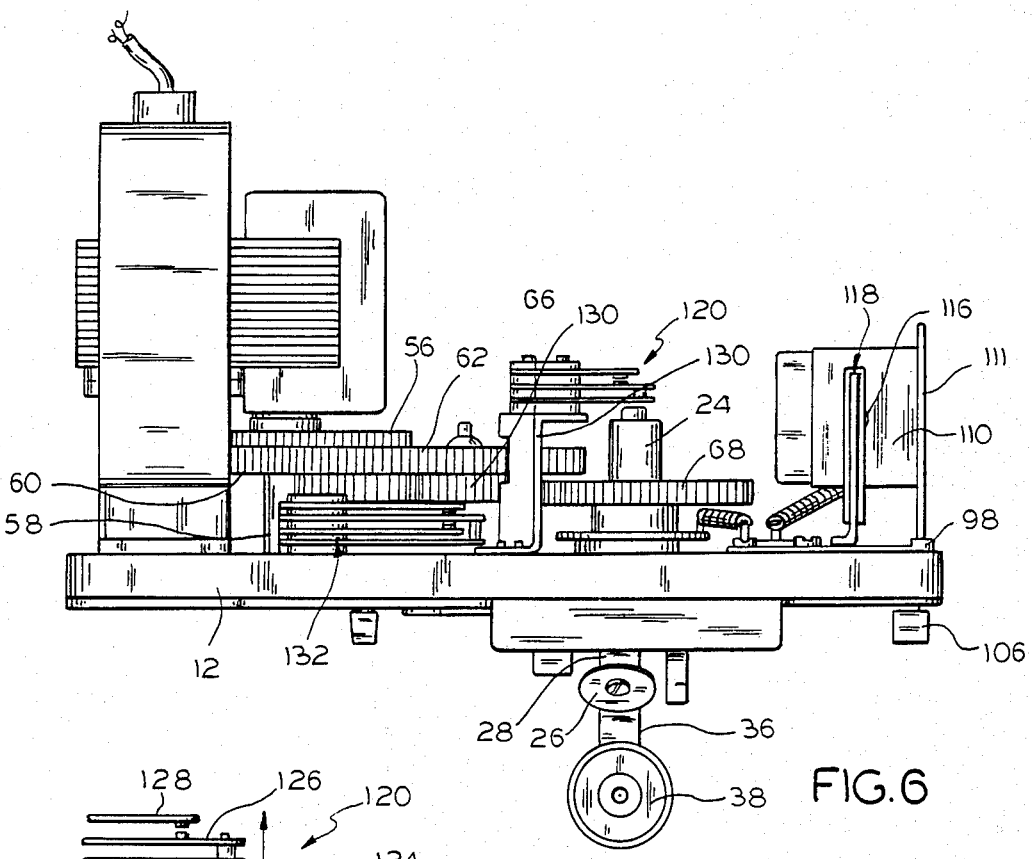
FIG. 6 is a lower plan view taken along the lines 6—6 of FIG. 4.

With reference also to FIGS. 4–6, an electrical motor 50 is mounted with a bracket 52 to the inner side of the front wall 12. The motor 50 includes a geared output shaft 54 engaging a first gear 56 rotatably mounted on a first shaft 58 fixed to the inner side of front wall 12. A second gear 60, having a smaller radius then the first gear 56, is affixed to the first gear 56 for rotation therewith about the first shaft 58.

The second gear 60 engages a third gear 62 which is rotatably mounted on a second gear shaft 64 also fixed to the wall 12. A fourth gear 66, having a radius less than the radius of the third gear 62, is affixed to the third gear 62 for rotation therewith about the second shaft 64. The fourth gear 66 engages a fifth gear 68 which is affixed to and rotatable with the drive shaft 24, discussed above. Accordingly, when the motor 50 is energized, its geared output shaft 54 drives the gears 56, 60, 62, 66 and 68 to rotate the turning wheel 22.

Although the preferred embodiment is described utilizing gears coupling the motor 50 to the turning wheel 22, other drive mechanisms, such as belts, could also be utilized, as is obvious to those skilled in the art.

Figure 7:
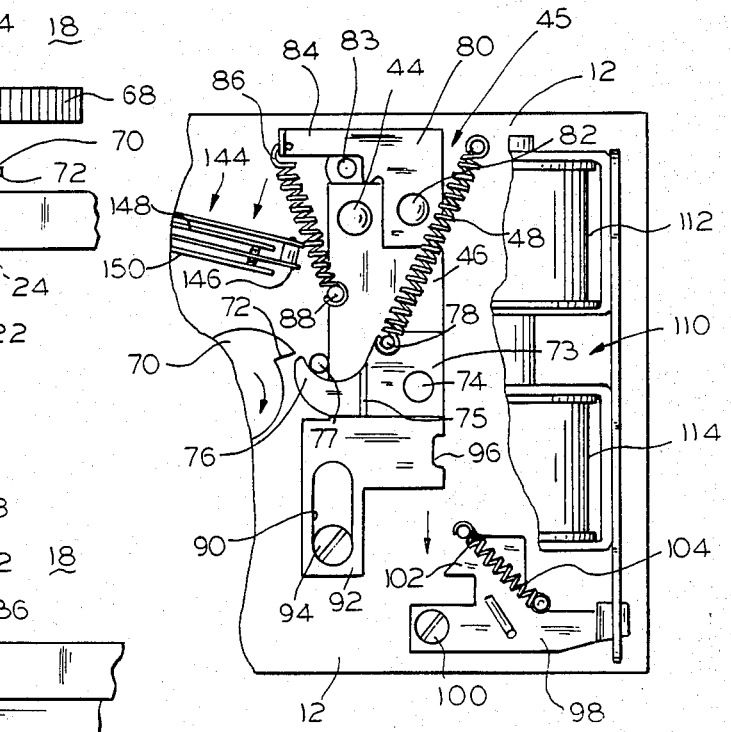
FIG. 7 is a partial plan view similar to that in FIG. 4 with parts cut away to particularly illustrate an actuator mechanism.

Also fixed to the turning wheel shaft 24 is a rotary cam 70 including a pair of radial toothed portions 72, one of which is shown in detail in FIG. 7, spaced 180° about its periphery. Operation of the motor 50 therefore also causes the cam 70 to rotate.

The actuator 45, in addition to the plate 46, comprises a first lever 73 pivotally secured at pin 74 to the plate 46. The lever 73 includes a distal finger portion 76 connected by an outwardly turned portion 75. A pin 77 extending rearwardly from the front wall 12 engages the finger portion 76 to maintain the first lever 73 in a pivotal downward position when the plate 46 is in the normal unlatched position, as shown in FIG. 7. The finger portion 76 is engageable with the cam toothed portions 72, as discussed more specifically below. The outwardly turned portion 75 transfers downward movement of the lever 73 to the plate 46. The bias spring 48, as discussed above, is affixed to the actuator 45 using a stud 78 extending perpendicularly from he lever 73 to bias the actuator 45 upwardly. The spring 48 also biases the first lever 73 pivotally upwardly when the actuator 45 is in the latched position, discussed below, to prevent engagement between the cam toothed portion 72 and the lever finger portion 76.

A second lever 80 is pivotally connected to the plate 46 with a pin 82. The second lever 80 includes a distal arm portion 84 connected with a spring 86 to the plate 46 at a stud 88 to bias the lever 84 in its downward pivotal position. Downward movement of the second lever 80 is restricted by a stud 83 extending rearwardly from the plate 30 through the front wall aperture 40. The stud 83 has the further effect of adding downward spring loading to the pivotal action of the plate 30 and the cutting blade 26.

An elongated aperture 90 is provided at a lower end 92 of the plate 46. A fastener, as screw 94 extends loosely through the opening 90 and is fastened to the inner side of the front wall 12. A notch 96 is provided in the plate lower end 92.

As is apparent from the above, rotation of cam 70, when driven by the motor 50, causes the toothed portions 72 to engage the finger portion 76 causing the actuator 45 to move downwardly against the force of the spring 48. Owing to the elongated shape of the plate aperture 90, and the aperture 40 through the front wall 12, the actuator 45 acts as a crank whereby rotary motion of the cam 70 is translated to substantially linear motion of the plate 46.

Upon further rotation, the toothed portion 72 disengages the finger 76. Normally, the spring 48 acting on the lever 73 would urge the plate 46 upwardly. However, a latch mechanism 98, pivotally secured to the inner side of front wall 12 at fastener 100, includes a finger portion 102 which engages the notch 96. A spring 104 connected to the latch mechanism 98 and the wall 12 biases the latch mechanism in a counter-clockwise direction. Accordingly, the latch mechanism 98 effectively latches the actuator 45 in its downward position when driven downwardly by rotary movement of the cam 70. A release handle 106, See FIG. 1, is coupled through an opening 108 in the front wall 12 to the latch mechanism 98. Downward movement of the release handle 106 pivots the latch mechanism 98 clockwise against the force of the spring 104 to disengage the finger 102 from the notch 96 to permit upward movement of the actuator element 45 by the bias spring 48.

An electrically operated solenoid 110 mounted to the wall 12 with stand-off 111, includes first and second coils 112 and 114, respectively. The solenoid 110 includes an actuator 116 which is normally urged upwardly if the coils 112 and 114 are deenergized, and is moved downwardly responsive to the coils 112 and 114 being energized. The actuator 116 engages a bracket 118 which is affixed to and extends rearwardly from the latch mechanism 98, See FIG. 4. The solenoid 110 when energized operates similarly to the release handle 106 by pivoting the latch mechanism 98 in the clockwise direction.

As discussed above, the rod 44 attached to the plate 46 is received in the opening 42 of the plate 30. Accordingly, when the actuator 45 is moved downwardly into engagement with the latch mechanism 98, the plate 30 is pivotally moved downwardly to a latched position, whereby the turning wheel 22 and cutting blade 26 are closely spaced. Particularly, when a can is held in a substantially upright position and the lower edge of the lip of the can is in contact with the periphery of the turning wheel 22, downward movement of the plate 30 causes the blade 26 to pierce the top of the can, and the close spacing between the blade 26 and the wheel 22 is sufficient to retain the lip of the can therebetween so that the can need not be further supported during the cutting operation discussed below.

A turning wheel switch 120, particular illustrated in FIG. 8, includes an actuator in the form of a rod 122 which extends through longitudinal axial openings through the turning wheel 22 and the drive shaft 24. A distal end 124 of the rod 122 extends into the chamber 18. The turning wheel switch 120 includes a moveable contact 126 moveable by the actuator rod end 124. A fixed contact 128 is spaced from the moveable contact 126. With particular reference to FIG. 6, the fixed and moveable contacts 126 and 128 are mounted using suitable insulators and a stand-off 130 to the inner side of the front wall 12. When the actuator 122 is depressed, as when a can to be opened is placed in a substantially upright position with the lower edge of the lip of the can above the turning wheel periphery and the sidewall thereof against the actuator 122, the actuator inner end 124 moves the moveable contact 126, as indicated by the arrow, into contact with the fixed contact 128.

Figure 9:
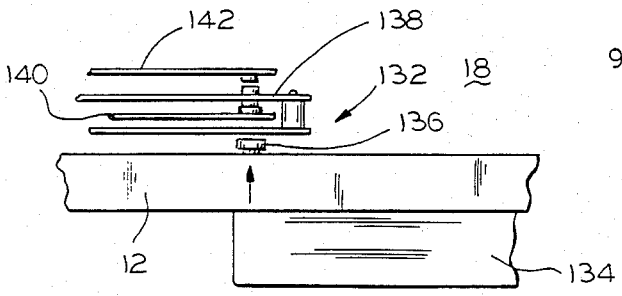
FIG. 9 is a detailed view illustrating a stand-off switch for the can opener of FIG. 1.

With particular reference to FIG. 9, a stand-off switch 132 includes an actuator in the form of a elongated bar 134 which is mounted across the outer side of the front wall 12 below the turning wheel 22. A stud 136 is connected to the bar 134 and extends through an opening (not shown) in the front wall 12 into the chamber 18. The stand-off switch 132 includes a moveable contact plate 138 and first and second fixed contact plates 140 and 142, respectively. In its normal shelf position, the moveable contact 138 is in contact with the first fixed contact 140 and is spaced from the second fixed contact 142. When the bar 134 is depressed, as when a can is placed with its sidewall against the bar 134, the stud 136 moves the moveable contact 138, as indicated by the arrow, until the moveable contact 138 is in electrical contact with the second fixed contact 142 and is spaced from the first fixed contact 140. As is illustrated generally in FIGS. 5 and 6, the switch 132 is mounted, using suitable insulators and fasteners directly to the inner side of the front wall 12.

With particular reference to FIG. 7, an end-of-cut switch 144 includes a moveable contact plate 146 and first and second fixed contact plates 148 and 150, respectively. Normally, the moveable contact plate 146 is in contact with the first fixed contact plate 148 and spaced from the second fixed contact plate 150. When the actuator element 45 is moved downwardly to its fullest extent, as discussed above, the arm 84 of the second lever 80 moves the moveable contact plate 146, as indicated by the arrow, so that the moveable contact plate 146 makes an electrical contact with the second fixed contact plate 150 and becomes spaced from the first fixed contact plate 148.

In actual operation, when the actuator 45 is moved downwardly, with a can in place, the blade 26 pierces the top of the can. However, a back pressure is applied on the blade 26 where the top is not cut. This back pressure restricts downward pivotal movement of the cutting blade 26 and the plate 30. Accordingly, the stud 83 restricts movement of the arm 84, causing the arm 84 to be slightly spaced from the movable contact plate 146. However, at the completion of a cutting cycle, when the can top has been cut around its entire periphery, the blade 26 and also the stud 83 moves further downwardly under the action of the spring 86 on the arm 84 against the stud 83 in the absence of such back pressure causing the arm 84 to actuate the end-of-cut switch 144.

Figure 3:
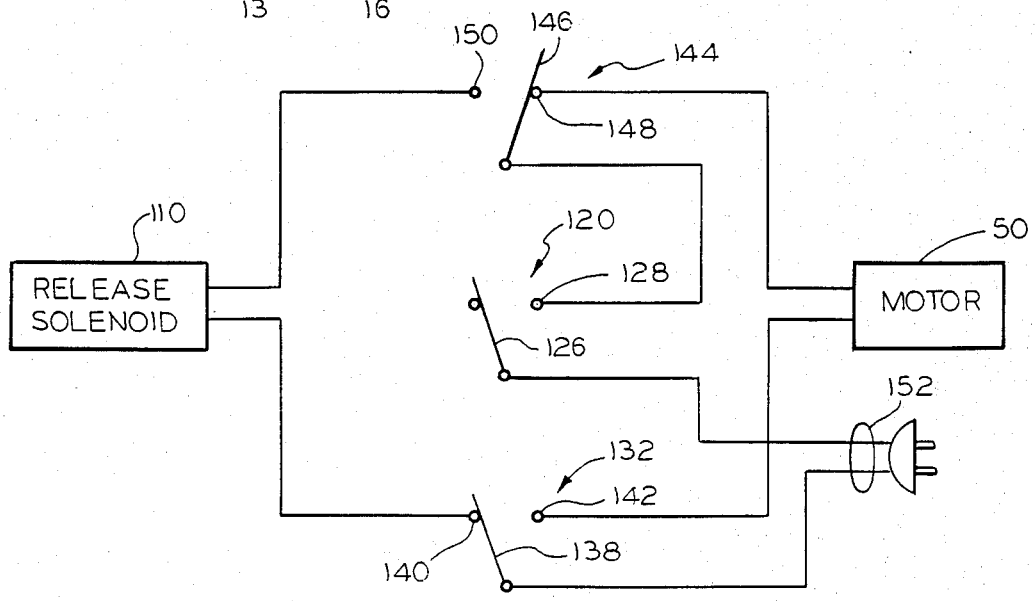
FIG. 3 is an electrical schematic illustrating a control circuit for the can opener of FIG. 1.

With reference to FIG. 3, an electrical schematic illustrates the connections between the various electrical components described above. A power cord 152 for plugging into a conventional 120 volt ac outlet has one of its conductors connected to the turning wheel switch moveable contact 126 and its other conductor connected to the stand-off switch moveable contact 138. The motor 50 is connected to the stand-off switch second fixed contact 142 and to the end-of-cut switch first fixed contact 148. The solenoid is connected to the stand-off switch first fixed contact 140 and to the end-of-cut switch second fixed contact 150. The moveable contact 146 of the end-of-cut switch 144 is connected to the turning wheel fixed contact 128.

The electrical schematic of FIG. 3 is illustrated with contacts in their normal shelf state. Accordingly, no power is supplied to either the motor 50 or the solenoid 110.

In operation, when it is desired to open the top of a can, illustrated in phantom FIG. 2, with the lower lip of the can radially above the turning wheel 22, and the sidewall thereof abutting the turning wheel switch actuator 122 and the stand-off switch bar 134, the turning wheel switch moveable contact 126 makes electrical contact with its associated fixed contact 128, as discussed above. Similarly, the stand-off switch moveable contact 138 becomes spaced from its associated first fixed contact 140 and makes electrical contact with its second fixed contact 142. As a result, a complete circuit is provided from the power cord 152 through the stand-off switch moveable contact 138 and second fixed contact 142, the motor 50, the end-of-cut switch first fixed contact 148 and moveable contact 146, and the turning wheel switch fixed contact 128 and moveable contact 126 to thereby energize the motor 50. Immediately upon the motor becoming energized, the turning wheel shaft 24 is rotated causing the turning wheel 22 and the cam 70 to rotate. Rotation of the cam 70 and its toothed portion 72 causes the actuator 45 to move downwardly resulting in pivotal movement of the plate 30 to a position whereby the cutting blade 26 pierces the top of the can. The latch mechanism 98 retains the actuator 45, and thus the blade 26, in the downward position. As discussed above, although the blade 26 pierces the can, back pressure is applied thereon to prevent the end-of-cut switch 144 from becoming actuated. The blade 26 and turning wheel 22 are thus closely spaced to retain the lip of the can therebetween so that the can need not be further supported manually. Also, the teeth on the turning wheel 22 cause the can to rotate, which rotation causes the blade 26 to cut around the periphery of the top in a conventional manner.

Once the top of the can has been completely cut, the back pressure is released resulting in the blade 26 moving slightly downwardly causing the lever arm 84 to actuate the end-of-cut switch 144, resulting in its moveable contact 146 breaking contact with the first fixed contact 148 and making contact with the second fixed contact 150. Resultantly, there is no longer a complete circuit from the power cable 152 to the motor 50, the motor stops, and the can is no longer rotated by the turning wheel 22. Nevertheless, the close spacing between the blade 26 and the turning wheel 22 resulting from the latching of the actuator 45 by the latch mechanism 98 results in the can being retained by the can opener. Similarly, the top which is typically made of tin plated steel or the like, is attracted by the magnet 38 which slightly spaces it from the can.

Thereafter, when a user grasps the can, as to remove it from the can opener, normal action of pulling the can away results in the can pivoting at its top which is held by the turning wheel 22 and blade 26, causing the side wall thereof to release the stand-off switch actuator 134, while still actuating the turning wheel actuator 122. Accordingly, the stand-off switch moveable contact 138 returns to its normal position spaced from the second fixed contact 142 and in contact with the first fixed contact 140. As can be seen, a circuit is then complete from the power cable 152, through the stand-off switch moveable contact 138 and first fixed contact 140, the release solenoid 110, the end-of-cut switch second fixed contact 150 and moveable contact 146, and the turning wheel switch fixed contact 128 and moveable contact 126. Resultantly, the solenoid is energized causing its actuator 116 to move downwardly to pivot the latch mechanism 98 downwardly so that the finger 102 thereof is removed from the actuator element notch 96 to permit the force of the bias spring 48, to return the actuator 45 to its normal position. Therefore, the plate 30, and thus blade 26 pivot upwardly so that the blade 26 is spaced from the turning wheel 22 and the lip of the can is no longer retained therebetween, and the can may be further removed for emptying its contents. As will be appreciated, in actuality, such removal operation occurs substantially instantly when the can is grasped in an attempt to remove same.

The upward movement of the actuator 45 causes the arm 84 to move upwardly away from the end-of-cut switch 144 so that the moveable contact 146 returns to its normal position in contact with the first fixed contact 148. Likewise, when the can is removed, the turning wheel switch actuator 122 is no longer depressed, and its moveable contact 126 becomes spaced from its fixed contact 128, and both the motor 50 and release solenoid 110 are deenergized and the can opener is in a condition to await a subsequent operation.

As is apparent from the above, an automatic can opener is provided which is operable by use of only a single hand which is used merely to place the can in a cutting position prior to opening same, and which is merely pulled away for removal when the cutting operation is completed. Particularly noteworthy, no additional levers or buttons must be depressed by the second hand of a user thereof, and no unnatural movement of the can must be implemented to cause operation of the can opener.

Thus, the invention broadly comprehends a can opener which provides an automatic release when a user thereof attempts to remove the can therefrom.

The foregoing disclosure of the preferred embodiment is illustrative of the broad inventive concepts comprehended by the invention.

I claim:

1. An automatic can opener comprising:

a housing having an outer wall defining an inner chamber;

a rotary turning wheel outwardly of said wall coupled to a shaft extending into said chamber;

a motor having an output shaft together with means for coupling said output shaft to said turning wheel shaft for rotary driven movement thereof;

a cutting blade;

electrically operable actuator means operatively associated with said motor for effecting movement of said cutting blade between positions respectively proximate to and remote from said turning wheel;

sensing means for sensing when a can is placed proximate said wall in a select opening position;

first control means coupled to said motor, said actuator means and said sensing means for automatically operating said can opener in a cutting mode, whereby responsive to said sensing means sensing a can in the select opening position, said actuator means moves said blade proximate to said turning wheel to retain the upper lip of the can therebetween and thus retain the can in the opening position, and said motor is energized to rotate said turning wheel to cut through the periphery of a top portion of the can; and second control means coupled to said actuator means and said sensing means for automatically operating said can opener in a release mode, whereby responsive to said sensing means sensing that the can is moved partially away therefrom, said actuator means moves said blade remotely from said turning wheel to release the can from the opening position.

2. An automatic can opener comprising:

a housing having an outer wall defining an inner chamber;

a rotary turning wheel outwardly of said wall coupled to a shaft extending into said chamber;

a motor having an output shaft together with means for coupling said output shaft to said turning wheel shaft for rotary driven movement thereof;

a cutting blade;

electrically operable actuator means operatively associated with said motor for effecting movement of said cutting blade between positions respectively proximate to and remote from said turning wheel, said actuator means comprising a plate pivotally mounted to said outer wall and having a shaft mounting said cutting blade, said actuator means being operable to convert rotary movement of said output shaft to pivotal movement of said plate;

sensing means for sensing when a can is placed proximate said wall in a position to be opened;

first control means coupled to said motor, said actuator means and said sensing means for automatically operating said can opener in a cutting mode, whereby responsive to said sensing means sensing a can, said actuator means moves said blade proximate to said turning wheel to retain the upper lip of the can therebetween, and said motor is energized to rotate said turning wheel to cut through the periphery of the top of the can; and second control means coupled to said actuator means and said sensing means for automatically operating said can opener in a release mode, whereby responsive to said sensing means sensing that the can is moved partially away therefrom said actuator means moves said blade remotely from said turning wheel to release the can.

3. The can opener of claim 2 wherein said actuator means further comprises a cam rotated by said turning wheel shaft, said cam engaging a linearly moveable actuator which is coupled to said plate.

4. The can opener of claim 3 wherein said cam is fixed to said turning wheel shaft.

5. The can opener of claim 1 wherein said actuator means further comprises latching means responsive to rotary movement from said output shaft for latching said blade in said position proximate to said turning wheel.

6. The can opener of claim 5 wherein said second control means includes means for operating said latch means to release said blade to position said blade in said position remote from said turning wheel to release said can.

7. An automatic can opener comprising:

a housing having an outer wall defining an inner chamber;

a rotary turning wheel outwardly of said wall coupled to a shaft extending into said chamber;

a motor having an output shaft together with means for coupling said output shaft to said turning wheel shaft for rotary driven movement thereof;

a cutting blade;

electrically operable actuator means operatively associated with said motor for effecting movement of said cutting blade between positions respectively proximate to and remote from said turning wheel;

sensing means for sensing when a can is placed proximate said wall in a position to be opened;

first control means coupled to said motor, said actuator means and said sensing means for automatically operating said can opener in a cutting mode, whereby responsive to said sensing means sensing a can, said actuator means moves said blade proximate to said turning wheel to retain the upper lip of the can therebetween, and said motor is energized to rotate said turning wheel to cut through the periphery of the top of the can;

second sensing means for sensing when said blade has cut completely around the periphery of the can and means coupled to said second sensing means and said motor for deenergizing said motor responsive to said second sensing means sensing the completion of the cutting of the can top; and second control means coupled to said actuator means and said sensing means for automatically operating said can opener in a release mode, whereby responsive to said sensing means sensing that the can is moved partially away therefrom said actuator means moves said blade remotely from said turning wheel to release the can.

8. An automatic can opener comprising:

a housing having an outer wall defining an inner chamber;

a rotary turning wheel outwardly of said wall coupled to a shaft extending into said chamber;

a motor having an output shaft together with means for coupling said output shaft to said turning wheel shaft for rotary driven movement thereof;

a cutting blade;

electrically operable actuator means operatively associated with said motor for effecting movement of said cutting blade between positions respectively proximate to and remote from said turning wheel, said actuator means comprising latching means responsive to rotary movement from said output shaft for latching said blade in said position proximate to said turning wheel;

sensing means for sensing when a can is placed proximate said wall in a position to be opened;

first control means coupled to said motor, said actuator means and said sensing means for automatically operating said can opener in a cutting mode, whereby responsive to said sensing means sensing a can, said actuator means moves said blade proximate to said turning wheel to retain the upper lip of the can therebetween, and said motor is energized to rotate said turning wheel to cut through the periphery of the top of the can; and second control means including an electrically operated solenoid in engagement with said latching means and coupled to said sensing means for automatically operating said can opener in a release mode, whereby responsive to said sensing means sensing that the can is moved partially away therefrom, said actuator means operates said latch means to release said blade to position said blade in said position remote from said turning wheel to release said can.

9. An automatic can opener comprising:

a housing having an outer wall defining an inner chamber;

a rotary turning wheel outwardly of said wall affixed to a shaft extending into said chamber;

a motor mounted in said chamber having an output shaft;

a gear mechanism rotarily coupling said motor output shaft and said turning wheel shaft;

a cutting blade;

mounting means for movably mounting said cutting blade outwardly of said housing in spaced relation with said turning wheel;

actuator means coupled between said gear mechanism and said mounting means for moving said mounting means responsive to rotational movement of said gear mechanism to vary said spacing between said blade and said turning wheel;

latch means responsive to movement of said actuator means for retaining said actuator means in a position whereby said blade is spaced from said turning wheel a distance sufficient to support the upper lip of a can therebetween;

unlatch means operable for releasing said latch means to permit movement of said blade away from said turning wheel a distance so as to not support the upper lip of a can therebetween;

first sensing means for sensing when a can is positioned proximate said housing in a preselected opening position;

second sensing means for sensing when said blade has ended cutting the can; and a control means coupled to said first and second sensing means, said unlatch means and said motor for automatically operating said can opener, said control means being operable to start said motor responsive to said first sensing means sensing a can positioned in the preselected opening position to thereby move said actuator means until said latch means retains said actuator means to retain said can and commence cutting the top thereof; to stop said motor responsive to said second sensing means sensing that the blade has ended cutting the can; and to operate said unlatch means to release said actuator means for releasing the can by movement of said blade away from said wheel when said first sensing means senses that the can is no longer in said preselected opening position.

10. The can opener of claim 9 wherein said control means further includes means for operating said unlatch means to release said actuator means only after said second sensing means senses that the blade has ended cutting the can.

11. The can opener of claim 9 wherein said actuator means comprises a crank having an actuator plate, said crank being operable to convert rotary movement of said gear mechanism to substantially linear movement of said plate.

12. The can opener of claim 11 wherein said actuator means further includes means for coupling said plate to said mounting means.

13. The can opener of claim 12 wherein said latch means comprises a latching mechanism pivotally mounted in said housing for engaging a notch in said actuator plate when said plate has been moved responsive to rotary movement of said gear mechanism.

14. The can opener of claim 9 wherein said unlatch means comprises an electrically operable solenoid having a actuator engaging said latch means and operable for releasing said latch means.

15. The can opener of claim 9 wherein said unlatch means comprises a manually operable handle engaging said latch means.

16. The can opener of claim 9 wherein said first sensing means comprises a stand-off switch having an actuator outwardly of said outer wall below said turning wheel which actuates an electrical contact mounted in said chamber.

17. The can opener of claim 16 wherein said first sensing means further comprises a turning wheel switch having an actuator extending through an axial opening in said turning wheel shaft actuating an electrical contact mounted in said chamber.

18. The can opener of claim 17 wherein said control means includes circuit means operable to start said motor responsive to said turning wheel switch and said stand-off switch both being actuated at the said time, and to operate said unlatch means responsive to said stand-off switch being subsequently deactuated.

19. The can opener of claim 17 wherein said circuit means is operable to operate said unlatch means only after said second sensing means senses that the blade has ended cutting the can.

20. An automatic can opener comprising:

a housing having an outer wall defining an inner chamber;

a rotary turning wheel outwardly of said wall and having a shaft extending into said chamber;

a motor mounted in said chamber having an output shaft;

gear means for rotarily coupling said motor shaft and said turning wheel shaft;

a cutting blade;

mounting means for pivotally mounting said blade to said wall in spaced relation with said turning wheel;

a moveable actuator means coupled between said gear means and said mounting mean for converting rotary movement of said gear means to limited pivotal movement of said blade;

latch means responsive to movement of said actuator means for latching said actuator means so that said blade is spaced from said turning wheel a distance sufficient to support the upper lip of a can therebetween;

electrically operable unlatch means for unlatching said actuator means to permit pivotal movement of said blade away from said turning wheel a distance so as to not support the upper lip of a can therebetween;

a turning wheel switch adjacent said turning wheel actuable responsive to a ca being positioned proximate thereof;

a stand-off switch mounted outwardly of said outer wall actuable responsive to a can being positioned with a sidewall thereof proximate said wall;

an end-of-cut switch actuable responsive to complete downward pivotal movement of said blade after the blade has completed cutting the can; and control circuit means including a respective electrical contact associated with each of said switches for implementing automatic operation of said can opener, said control circuit means being coupled to said unlatch means and said motor, said control circuit means being operable to start said motor responsive to said turning wheel switch and said stand-off switch contacts being actuated at the same time to thereby move said actuator means until said latch means latches said actuator means to retain the can and commence cutting the top thereof, and thereafter to stop said motor to cease cutting the top of the can responsive to said end-of-cut switch contact being actuated after the blade has completed cutting the can, and operating said unlatch means when said stand-off switch contact is deactuated to thereby unlatch said actuator means to automatically move said blade away from said turning wheel to release the can.

21. The can opener of claim 20 wherein said control circuit means includes means for operating said unlatch means to thereby unlatch said actuator means only after said end-of-cut switch has been actuated.

22. The can opener of claim 20 wherein said mounting means comprises a plate pivotally mounted to said outer wall and including means for mounting said blade thereon.

23. The can opener of claim 20 wherein said actuator means comprises a crank having an actuator plate, said crank being operable to convert rotary movement of said gear means to substantially linear movement of said plate.

24. The can opener of claim 23 wherein said latch means comprises a latching mechanism pivotally mounted in said housing for engaging a notch in said actuator plate when said plate has been moved responsive to rotary movement of said gear means.

25. The can opener of claim 21 wherein said unlatch means comprises a solenoid having a coil and an actuator, wherein said actuator engages said latch means to unlatch said actuator means if said coil is energized.

26. The can opener of claim 25 wherein each of said stand off switch and said end-of-cut switch is a two position switch, and wherein said control circuit means connects said motor to a source of power when said stand-off switch is actuated and said end-of-cut switch is deactuated to operate the motor, and connects said solenoid to a source of power when said end-of-cut switch is actuated and said stand-off switch is deactuated to automatically release the can.

* * * * *